US009746874B2

(12) United States Patent
Johnson et al.

(10) Patent No.: US 9,746,874 B2
(45) Date of Patent: Aug. 29, 2017

(54) ERGONOMICALLY SYMMETRIC PEDAL CONTROL SYSTEM

(71) Applicants: Robert E. Johnson, Hendersonville, TN (US); Paul R. Johnson, Brentwood, TN (US)

(72) Inventors: Robert E. Johnson, Hendersonville, TN (US); Paul R. Johnson, Brentwood, TN (US)

(73) Assignee: Johnson Technologies Corporation, Nashville, KY (US)

( * ) Notice: Subject to any disclaimer, the term of this patent is extended or adjusted under 35 U.S.C. 154(b) by 0 days.

(21) Appl. No.: 14/120,897

(22) Filed: Jul. 8, 2014

(65) Prior Publication Data

US 2015/0075318 A1 Mar. 19, 2015

Related U.S. Application Data

(60) Provisional application No. 61/957,529, filed on Jul. 8, 2013.

(51) Int. Cl.

| | |
|---|---|
| ***G05G 1/34*** | (2008.04) |
| ***G05G 1/30*** | (2008.04) |
| ***G05G 1/44*** | (2008.04) |

(52) U.S. Cl.

CPC ..... *G05G 1/44* (2013.01); *G05G 1/34* (2013.01); *Y10T 74/2054* (2015.01)

(58) Field of Classification Search

CPC .. G05G 1/34; G05G 1/36; G05G 1/44; G05G 1/445; G05G 1/46; G05G 11/00; D05B 69/18; H01H 21/26; Y10T 74/20528; Y10T 74/20906; Y10T 74/2054

USPC ..... 74/478, 512, 514, 560–564; 112/217.3, 112/217.4; 428/909

See application file for complete search history.

(56) References Cited

U.S. PATENT DOCUMENTS

| | | | | |
|---|---|---|---|---|
| 2,589,975 A | | 3/1952 | Sprinkel et al. | |
| 2,647,414 A | | 8/1953 | Nafe et al. | |
| 2,671,268 A | | 3/1954 | Crawford | |
| 2,983,347 A | | 5/1961 | Risk | |
| 3,134,270 A | | 5/1964 | Cole | |
| 3,224,294 A | | 12/1965 | Gresham | |
| 3,282,123 A | | 11/1966 | Klingaman | |
| 3,327,662 A | * | 6/1967 | Ahate | D05B 75/02 112/217.3 |
| 3,354,743 A | | 11/1967 | Strauss | |
| 3,980,848 A | | 9/1976 | Schulz et al. | |
| 4,142,080 A | | 2/1979 | Takahashi | |
| 4,152,951 A | | 5/1979 | Korczykowski | |
| 4,285,144 A | * | 8/1981 | Power | A43B 17/14 36/140 |

(Continued)

*Primary Examiner* — Adam D Rogers

(74) *Attorney, Agent, or Firm* — Carrithers Law Office, PLLC

(57) ABSTRACT

An industrial symmetric pedal control system is provided which allows for ergonomically favorable operation by paired reciprocal control pedals which mirror an operator's right and left limbs. The reciprocal mirror control pedals allow operation of the same predetermined function within designated machinery by either the left or right foot of an operator, thus reducing fatigue while maintaining proper position at a particular workstation. Also included in the system is an ergonomically designed floor mat to provide the operator with more comfort and less fatigue while operating machinery.

23 Claims, 12 Drawing Sheets

(56) References Cited

U.S. PATENT DOCUMENTS

| | | | | | |
|---|---|---|---|---|---|
| 4,354,071 | A | | 10/1982 | Pietschmann | |
| 4,413,429 | A | * | 11/1983 | Power | A43B 17/003 36/30 R |
| 4,586,398 | A | | 5/1986 | Yindra | |
| 4,810,024 | A | * | 3/1989 | Heller | B60N 3/044 296/97.23 |
| 5,067,368 | A | | 11/1991 | Itakura et al. | |
| 5,351,571 | A | | 10/1994 | Johnson | |
| 5,495,817 | A | * | 3/1996 | Zeigler, Sr. | D05B 29/02 112/217.3 |
| 7,993,726 | B2 | * | 8/2011 | Johnson | A47G 27/0231 15/215 |

* cited by examiner

ERGONOMICALLY SYMMETRIC PEDAL CONTROL SYSTEM

CROSS-REFERENCE TO RELATED APPLICATIONS

This application claims priority from applicant's U.S. Provisional Patent Application Ser. No. 61/957,529 filed on Jul. 8, 2013 which is hereby incorporated by reference in its entirety.

TECHNICAL FIELD

The present invention relates to a control device operable when the user applies pressure to selected pedals to operate specific functions on connected machinery. By ergonomic design, the present invention allows control of the machinery operation by use of either foot to avoid fatigue and related operator errors and includes reciprocal pedals which, when operated will stop the process which had been started by previous operation of a previously selected pedal. Also included is a fatigue reducing floor mat, containing selected compressibility characteristics, on which the operator stands while operating a given machine. This device facilitates proper head and trunk orientation to a specific task and makes a traditional static job rhythmic by allowing operator choice in limb selection, machine operation and stance.

BACKGROUND OF THE INVENTION

In industrial equipment operation, medical, and household equipment control, there are several situations which require control by depression of a pedal by the operator's foot. Various control devices have included the use of multiple pedals, each related to a separate function in the controlled device or which when operated together produced a desired function of the controlled device. When an operator has been required to stand during control of the device, all prior existing pedal control systems have led to significant musculoskeletal fatigue, inhibited circulation, lack of recuperation time, and have subjected operators to undue levels of unsupported stress in the knee, pelvic and ankle joints. When an operator's body is unevenly supported by an asymmetric lower limb, the supportive muscle around the joints tire quickly due to constant strain and lack of proper recovery time, therefore causing the stress load to shift onto the skeletal structure of the limb causing the operator to maintain a constant awkward posture. The operator's constant awkward posture causes unneeded musculoskeletal discomfort and fatigue, possibly tendinitis or arthritis and other potential repetitive stress injuries.

Machine operators suffer from discomfort and fatigue when standing on hard and unforgiving flooring such as concrete and masonry based flooring, rigid wood flooring, and sometimes steel plate flooring. According to occupational therapy doctors, a person standing at a static or limited range position at a workstation for prolonged periods of time may have significant cumulative trauma or other injury, such as musculoskeletal fatigue, or inhibited circulation. Further, when a person's body is unsupported, the muscles around the joints and spinal bones may tire quickly due to constant strain and stress. The skeletal structure of the limbs and the back of the human body has a difficult time maintaining an awkward or compressed posture at an improperly positioned workstation or an unsupported or un-insulated situation. The awkward posture can contribute to undesirable musculoskeletal discomfort and fatigue or inhibited circulation, such as tendinitis or arthritis, as well as reduced worker productivity and diminished quality as well as a multitude of lower musculoskeletal injuries.

Bunching and edge curling of past matting designs created tripping hazards in many settings, including occupational environments. Therefore, these problems are a top recordable complaint in occupational settings. Matting of past designs was commonly taped to the floor around the periphery to reduce movement resulting in extra man-hours and housekeeping concerns. Alternatively, the matting was glued to the floor making the matting a permanent one-time use product. Other mats were fastened to the floor via bolts or screws. This causes tripping hazards for personnel stepping on the hidden bolt studs and the like.

Compression deflection and compression set are figures utilized by padding manufacturers to perform quality testing on their materials regarding user comfort and product durability. Padding manufacturers have developed standardized tests to ensure that each batch of padding is consistent with prior and future batches. Compression deflection, also known as compression resistance, is a measurement of the amount of force that will deform a material 25% and from which the material will return to the original shape. Compression deflection is measured in pounds per square inch, or psi. Compression set is a measurement of the percentage of change exhibited by a material that has been compressed for twenty-four hours. Usually, the material is compressed fifty percent. After twenty-four hours, the compression force is released and the percent of set of the material is determined. The lower the number, the less set taken. For example, the height of a material is measured. A force is applied that compresses the material fifty percent for 24 hours. The force is released and the height of the material is measured. The new height is divided by the original height and multiplied by 100. This number is then subtracted from 100 to yield the compression set. Both of these measurements have standard test methods per the American Society for Testing and Materials (ASTM).

The present invention utilizes compression deflection and compression set factors to provide the necessary ergonomic support required by people in stationary or low-motion jobs. The standard was determined by the development of an ergonomic interaction factor. Using a person's determined ergonomic interaction factor (their weight divided by the contact area of the bottom of their feet), padding material can be varied to suit the intended purpose. For example, a person who weighs 200 lbs and has 50 squared inches of foot contact area on both feet exerts 4 pounds per square inch (psi) on the ground from merely standing. Therefore, the person would require a padding exhibiting at least 4 psi compression deflection for stationary activities (200 lbs/50 in.). This padding can take the form of the well-known stationary mats or can be incorporated in a shoe in the form of a stationary or insertable/removable insole. If that same person were to walk, they effectively remove half of the available contact area. This results in each foot exerting 8 psi (200 lbs/25 in.). They, therefore, would require padding with a minimum of 8 psi compression deflection for walking activities. If this person has a job that requires a large amount of standing and no walking, the shoes that this person uses to walk should not be the same shoes that this person uses at work. If this person also jogs, their walking shoes should differ from their jogging shoes because they may exert up to 20 psi with each impact (200 lbs/10 in.) and, therefore, require different padding. In an alternate embodiment, one shoe is made to be suitable for multiple activities (e.g., standing, walking and/or running) by inserting the appropriate insole into the shoe for the intended activity.

At the same time, the material should be able to bounce back after use. The material should exhibit low compression set. If the padding has the proper compression resistance for the intended purpose, compression set becomes less of an issue. If a person only exerts enough force to deflect the cushioning material 25%, they are not exerting the same amount of force that resulted in the compression set. The ASTM compression set method (D 1056) requires that the material be compressed 50%. In choosing a material, the lower the compression set factor the better. Repetitive use may alter the structure of the material as exhibited by wear patterns in the soles of shoes. If a person takes their stationary shoe that has 4 psi padding and goes jogging, the padding is subjected to forces as high as 20 psi. If the padding does not have sufficient compression set resistance, damage may result to the support provided in the shoes.

DESCRIPTION OF THE RELATED ART

Pedals for use in operating and controlling machinery such as sewing machines have been used and one such pedal control system is disclosed in Itakura, et at., U.S. Pat. No. 5,067,368. Itakura shows a mechanism for sewing machine control, and in FIG. 2 of that patent, a control device with three separate pedals is shown indicating separate controls related to separate and distinct functioning operations. A mechanism for allowing plural pedal controls where two pedals are required to control two distinct functions but allowing an identical tactile feel in both pedals is disclosed in Pietschmann, U.S. Pat. No. 4,354,071. However, the structure and device disclosed in Pietschmann specifically relates to allowing each of multiple pedals to control separate functions in the equipment through a single electrical sensing element.

There are also numerous other pedal control devices showing multiple pedals in various arrangements to allow for control of specific, distinct operations of the machinery by actuation of each separate foot control. The art of machinery control devices does not disclose the use of individual pedals operable by either foot to control the same function in the controlled machinery. Yindra, U.S. Pat. No. 4,586,398 for multiple controls operable by shifting the operator's foot in a sideways motion and Takahashi, U.S. Pat. No. 4,142,080 for a foot controller of a surgical microscope with separate foot-operated controllers for various functions of a surgical microscope appear in related art. However, each of these pedal controls for machinery merely disclose the capability of controlling distinct functions with separate distinct pedal actuators, or each of these would require an operator to change his or her entire position in order to actuate a particular pedal with a different foot.

This application incorporates by reference U.S. Pat. No. 5,351,571 for ERGONOMICALLY SYMMETRIC PEDAL CONTROL SYSTEM issued on Oct. 4, 1994.

SUMMARY OF THE INVENTION

In accordance with the present invention, there is provided a device comprising, consisting of, and/or consisting essentially of a control pedal system and a platform. The control pedal system is connected to a base and includes a first pair of reciprocally matched pedals pivotally connected to a second pair of reciprocally matched pedals so that the first pair is returned to a home position when the second pair is depressed. A means is included for generating a control signal from each pedal of the pairs of pedals such that corresponding pedals in the reciprocally matched pairs of pedal send the same control signal to a means for communicating the control signal to the machine. Each the pedals has an oval shaped peripheral edge and having an anti-skid textured top surface. The platform located adjacent to the base has a support structure that supports an operator such that the reciprocally matched pairs of pedals are disposed adjacent to and about the platform in a mirrored image fashion. The platform comprises a multilayer unit having a compression set in a range of 3 to 40% and a compression deflection in the range of 3 to 30 psi.

The present invention was conceived in response to a need for decreasing operator fatigue and resultant operator error related to the single-motion operation allowed by pedal control devices available in prior art. The solution to each single pedal operating a single function in the controlled machinery was solved by allowing a connected control system enabling the operator to control a particular or multiple particular machinery functions by use of either foot without requiring a move in position from a particular work station. Multiple linkage mechanisms and multiple equipment control mechanisms are available and adaptable to the invention, the essence of which is to provide an opportunity for a choice in and variations in limb selection for operation of a particular function. This allows an operator to vary throughout the working period their stance and combine rhythmic or random decisions related to which of the reciprocal control pedals are engaged, thus significantly controlling fatigue related to continual repetitious motions. The ergonomic pedal was designed to reduce, or eliminate factors contributing to excessive trauma, injury or fatigue. Prior pedal controls require operators to shift their weight while operating. In the prior art, body weight is consistently on a particular side of the lower body, because the currently available design of pedal controls does not allow for the weight to be placed on the "pedal foot" without severe angular stress and discomfort on that respective ankle.

The combination of standing on one foot, and awkward movement of the other, can and will lead to a multitude of injuries such as phlebitis and varicose veins to name a few. The multiple-foot pedal is designed to allow the user to shift his feet when one is fatigued to the opposite side. This symmetrical pedal has many distinct ergonomic and economic advantages. With the positioning of the front pedals, the weight of the body can be safely centered over both feet while simultaneously depressing the pedal to vary the speed of the machine. This pedal is not dexterity-biased. The user can be a left-footed or right-footed machine operator and still be 100% productive. This pedal allows the user to shift weight by using two feet while sewing, or allow the user to swing his/her sewing foot to use both pedals with one foot. The pedal control assembly can be mounted on a short base for attaching to a mat or mounted on top of a long base with operator matting on same surface of base as pedal. The long base may be typically painted wood or steel. The short attached operator mat is connected to the short platform supporting the pedal assembly with VELCRO hook and loop attachment means or snaps. One actuator valve for pneumatic control is triggered by a square shaft attached to pedals. Two brackets to secure air valve are a part of structural control towers standard.

The symmetrical design, of the ergonomic sewing pedal is not dexterity biased, therefore allowing the operator to stay centered in correct posture while using discretion in rotating support to the rested limb as the body deems necessary. An operator's muscles and lower extremities are subject to constant tension and stress required by old industry methods. The present invention provides the operator with frequent balanced rotations and rest, therefore promoting a natural physiological well being. It has been determined that a working platform of wood and rubber/elastomer/polymer composition provide therapeutic support and dual reciprocal controls promote proper balanced posture, needed musculoskeletal recovery and ergonomic safety. The sewing industry is realizing that stand-up sewing is more physiologically sound than the historic sit-down method, because proper posture is more natural when standing. Additionally standing utilizes the bigger muscles which are less prone to repetitive stress in juries (RSI's), whereas sitting requires smaller soft tissue muscle groups that are highly susceptible to injury. OSHA has now recommended standing positions as the preferred way to sew.

The tower is configured to include mounting holes for a plurality of machine control devices such as pneumatic controls and electronic speed controls which are available from numerous machinery suppliers. In another embodiment, two brackets to secure air valves are a part of structural control towers.

The present embodiment of the pedal control tower includes lightweight campongs such as an aluminum tower, pedals and pedal plate to facilitate easy moving and positioning of the pedal control tower.

The pedal system of the present invention is designed to be lighter for less stress in relocating. Typically smaller employees use the pedal more than larger individuals. The smaller employees will find ease in lifting and positioning the pedal control. The design parameters yield light weight to all of the components and have never before been combined in the pedal assembly. Components include an aluminum control tower, integral universal speed control plate for electronic attachments made out of and apart of the aluminum control tower along with aluminum air valve brackets also integral to the aluminum tower. Moreover, elimination of the excess parts inventory and order processing provides an economic incentive for the design of the unit.

The pedal control system utilizes technology from the mat and insole industry to develop a device having therapeutic foot resilience and performance value interaction with feet has been perfected. The best therapeutic affect depends on the proper selection of a resilient material and keeping it in the close proximity to the bottom of the individual's foot. Thinner material is planned for the new mat standing and operating support system. Yet foot distance to resilient support top vinyl from the floor will be closer by five sixteenth inches to three sixteenths. This lower profile mat height from the floor will allow improved mat comfort and less tripping hazard over past thicker version; further, there will be a less stressful transition to and from the floor and the operator work position on the mat. Greater ergonomic comfort penetrates the operator's foot. The newly specified top rubber has more density for wear ability and thickness is one sixteenth thinner than previous top rubber. Thus the operator's bottom foot surface is closer for more ergonomic comfort from the resilient material under the top rubber. The thinner resilient material will be high density, open cell polyurethane, ("PORON") or closed cell poly vinyl chloride.

In one embodiment, the pedal control assembly is mounted on a short base for attaching to a mat or mounted on top of a long base with operator matting on the same surface of base as pedal. The long base is typically painted wood or steel, fiber glass, or plastic such as nylon or a composite graphite material. The short attached operator mat is connected to the short platform supporting the pedal assembly with Velcro or snaps.

More particularly, the present invention comprises or consists of an asymmetric pedal control system including a base and a control pedal system connected to said base having a first pair of reciprocally matched pedals pivotally connected to a second pair of reciprocally matched pedal. The said first and second pairs are connected so that said first pair is returned to a home position when said second pair is depressed. A means for generating a control signal from each pedal of said pairs of pedals is provided so that corresponding pedals in said reciprocally matched pairs of pedal send the same control signal to a means for communicating said control signal to said machinery by causing a continuous change in an electrical parameter, such as electrical resistance or output voltage. Each of said pedals having an oval shaped peripheral edge and having an anti-skid textured top surface. A platform located adjacent to said base has a support structure that supports an operator such that said reciprocally matched pairs of pedals are disposed adjacent to and about said platform in a mirrored image fashion. The platform comprises a multilayer unit having a compression set in a range of 3 to 40% and a compression deflection in the range of 3 to 30 psi. The pedals of said reciprocally matched pairs of pedal are arranged so that when operated, a top surface of said pedals is aligned approximately even with a top surface of said platform. The platform is sized to allow engagement of pedals in one set of said reciprocally matched pairs of pedals by one of the feet of said operator and engagement of pedals in the other set of said reciprocally matched pairs of pedals by the other foot of said operator. The pedals in said reciprocally matched pairs of pedals have a contact surface defining the place of engagement by the feet of said operator which is slanted toward said base and located adjacent to an edge of said platform so that particular pedals can be engaged in a range of positions. The control system included quick disconnect mechanical linkage, wiring, pneumatics allowing easy and quick separation from, a machine controlled by said control system for quick connection to a second machine to be controlled by said control system. The pedal control devise enabling four optimal pedal selections being constructed in a mirror image duel controlled pattern with an overall functional width of between 10"-15" with the operative center point of stance in between these parameters. The mirror image duel controlled pattern with an over all width of 14"-19" with the scope of the center point in between these mechanical parameters where the said functions are located towards the forward portion of the said control. The pedal control devise with four forward operative pedal selections that can be operated by either the right foot or the left foot with a 5"-10" range of engagement from the center point of said control. The four pedal control device that can be operated by the right foot or left foot with a pivotal range from the heel of up to 10" from center point of said control. The control devise that enables four optional pedal selections that operates 1-4 machine functions. The pedal control devise enables four optional pedal selections with the primary variable speed functions being constructed in a mirror image duel controlled pattern. The two or more pedals can be mirror image for various dual control purposes. The spacing of the pedals and from center is only restricted by reach of the right and left feet keeping the operator in balance. The spacing for pedals range of motion from a horizontal center mid plane parallel to base cutting through the pedals' axis of rotation is plus or minus, i.e., of tilting motion measured from the pedal end furthest from the center mid plane is plus or minus zero to seventeen inches. The pedal min to max angle of rotation from the horizontal center mid plane parallel to base cutting through the pedals' axis of rotation is zero to fifty degrees plus or minus upward or downward motion. The pedals' surface perimeter may incorporate any geometric configuration angular, angular/curvy, and curvy with flat or raised surface. Pedals just designed for optimizing foot contact function and operator efficient comfort. The pedals' have a control tower of various shapes or sizes made from solid or combinations in steel or aluminum or composite or plastic for center point attachment to rotate and function. The tower is constructed with holes that can vary from one sixteenth to one inch in diameter to allow structural support for round shafts that penetrate the control tower which forms axles for the pedals to rotate and initiate their function. The holes are in the control tower for fastening brackets and plates for unique functions such as air valve actuation and electronic boxes that signal attached equipment activity. The lightening holes of any consistent shape are cut from the control tower just to create material voids that don't diminish function or strength of the control tower but reduce weight of the product. The control tower is affixed to a nonflexible base plate of steel, aluminum, composite, plastic or wood. The pedals have holes for pins and flat hinges to attach pedals together allowing interactive motion of pedals with each other providing a myriad of functions to occur from activating one pedal into motion causing reaction in the other pedal movement. Pins can be shoulder bolts and nuts or plan shafts secured with t nut caps of various sizes. The pedal control devise can mirror an individuals physiological center point of head and trunk in relation ship to natural stance and operative lower extremities which corresponds with primary forward and backward balance receptors in static and rhythmic movements.

It is an object of the present invention for the pedal control assembly to be mounted on a short base for attaching to a mat or mounted on top of a long base with operator matting on same surface of base as pedal. The long base may be typically painted wood or steel.

It is an object of the present invention for short attached operator mat to be connected to the short platform supporting the pedal assembly with VELCRO or snaps.

It is an object of the present invention for one actuator valve for pneumatic control is triggered by a square shaft attached to pedals.

It is an object of the present invention for the two brackets securing the air valve to be a part of structural control towers.

It is an object of the present invention for the pedals to have a control tower of various shapes or sizes made from solid or combinations in steel or aluminum or composite or plastic for center point attachment to rotate and function.

It is an object of the present invention the tower to be constructed with holes that can vary from one sixteenth to one inch in diameter to allow structural support for round shafts that penetrate the control tower which forms axles for the pedals to rotate and initiate their function.

It is an object of the present invention for providing holes in the control tower for fastening brackets and plates for unique functions such as air valve actuation and electronic boxes that signal attached equipment activity.

It is an object of the present invention to provide lightening holes of any consistent shape are cut from the control tower just to create material voids that don't diminish function or strength of the control tower but reduce weight of the product.

It is an object of the present invention for the control tower is affixed to a nonflexible base plate of steel, aluminum, composite, plastic or wood.

It is an object of the present invention to provide for two or more pedals can be mirror image for various dual control purposes.

It is an object of the present invention to provided for the distance pedals are apart from center is only restricted by reach of the right and left feet keeping the operator in balance.

It is an object of the present invention for the distance for the pedals range of motion from a horizontal center mid plane parallel to base cutting through the pedals' axis of rotation is plus or minus, i.e., of tilting motion measured from the pedal end furthest from the center mid plane is plus or minus zero to seventeen inches.

It is an object of the present invention for the pedal min to max angle of rotation from the horizontal center mid plane parallel to base cutting through the pedals' axis of rotation is zero to fifty degrees plus or minus upward or downward motion.

It is an object of the present invention for the pedals' surface perimeter to incorporate any geometric configuration angular, angular/curvy, and curvy with flat or raised surface. Pedals just designed for optimizing foot contact function and operator efficient comfort.

It is an object of the present invention for the pedals to have holes for pins and flat hinges to attach pedals together allowing interactive motion of pedals with each other providing a myriad of functions to occur from activating one pedal into motion causing reaction in the other pedal movement. Pins can be shoulder bolts and nuts or plan shafts secured with t nut caps of various sizes.

It is an object of this invention to provide an ergonomically symmetric pedal control system which contains a pair of pedals, a left pedal and a right pedal, which are mechanically tied together and therefore either pedal may be pushed to start an attached machine. Further a second pair of pedals, one on the left and the other on the right, are mechanically connected to the other pedals in such a way that pushing either one of the second pair of pedals quickly and positively reverses the action caused by pushing one of the first pair of pedals.

It is an object of this invention to provide an ergonomically symmetric pedal control system which includes an ergonomic mat which lies alongside the pedal base. The ergonomic mat has compression characteristics specifically chosen to increase a user's comfort and to decrease fatigue caused by standing next to and operating a machine for several hours each day.

It is an object of this invention to provide an ergonomically symmetric pedal control system which includes pedals with an overall oval shaped peripheral edge which reduces the likelihood of an operator catching his or her shoe on the edge of any of the pedals during operation.

It is an object of this invention to provide an ergonomically symmetric pedal control system wherein the top surface of the pedals is texturized with an anti-skid treatment such as rows and columns of upwardly facing pyramids, bumps, pebbles, or other irregularities providing traction and/or cushioning.

It is another object of the present invention to provide a pedal control assembly that can be mounted on a short base for attaching to a mat or mounted on top of a long base (typically painted wood or steel) with operator matting on the same surface of the base as the pedal.

It is an object of the present invention to provide a short attached operator mat connecting to a short platform supporting the pedal assembly with hook and loop fasteners "VELCRO", or snaps.

It is an object of the present invention to provide for one actuator valve for pneumatic control which can be triggered by a square shaft attached to the pedal(s).

It is another object of the present invention to provide two brackets to secure the air valve as a part of the structural control towers.

It is another object of the present invention for the pedal control devise enabling four optimal pedal selections being constructed in a mirror image duel controlled pattern with an overall functional width of between 10"-15" with the operative center point of stance in between these parameters.

It is another object of the present invention for the mirror image duel controlled pattern with an over all width of 14"-19" with the scope of the center point in between these mechanical parameters where the said functions are located towards the forward portion of the said control.

It is another object of the present invention for providing the pedal control devise with four forward operative pedal selections that can be operated by either the right foot or the left foot with a 5"-10" range of engagement from the center point of said control.

It is another object of the present invention for providing the four pedal control device that can be operated by the right foot or left foot with a pivotal range from the heel of up to 10" from center point of said control.

It is another object of the present invention for providing a control devise that enables four optional pedal selections that operates 1-4 machine functions.

It is another object of the present invention for providing a pedal control devise enabling four optional pedal selections with the primary variable speed functions being constructed in a mirror image duel controlled pattern.

It is another object of the present invention to provide a duel pedal control devise that mirrors an individuals physiological center point of head and trunk in relation ship to natural stance and operative lower extremities which corresponds with primary forward and backward balance receptors in static and rhythmic movements.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 8:
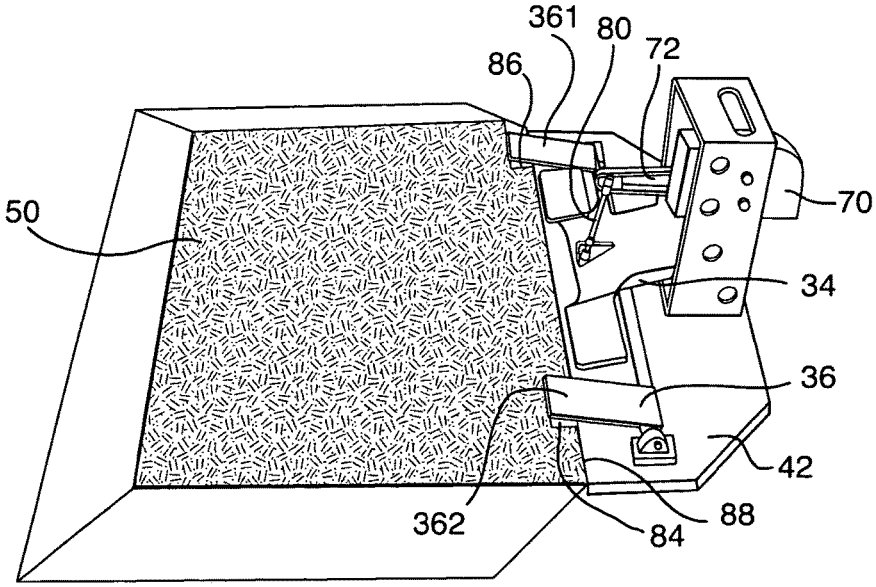
FIG. 8 is a side perspective view of the symmetric pedal control system 30 including an anti-fatigue mat.

As shown in FIGS. 1-23, reference numerals denote identical or corresponding parts and these reference numerals are used in the following description of this preferred embodiment. As shown in FIG. 8, one preferred embodiment constituting an integrated system of the invention entails a platform which includes reciprocal pedal controls for operation of an industrial sewing machine. The system provides in one unit both a padded work station platform 50 as well as ergonomically situated foot pedal controls operable with either the operator's left or right foot to control a piece of machinery, for example and industrial sewing machine.

The integrated sewing machine workstation of the applicant's previous patent, U.S. Pat. No. 5,351,571, shown in FIG. 1, includes a therapeutic workstation platform 11 with forward speed control pedals 6 and 'backtack' and cut control pedals 16, which may be operated to actuate a signal lever arm 2. It is contemplated that this same workstation can be used with other types of machines which can be operated by foot operated switches. The signal lever arm 2 engages predetermined control commands through the means for communicating control demands 1 with a sewing machine through any of several conventional function control signaling methods well known in industrial machinery control systems, such as electric circuitry, mechanical switches, pressure sensitive buttons, or direct mechanical drives. The structure of the therapeutic workstation platform 11 is important in the integrated operation of the control pedals 6 and 16. The platform 11 provides a slightly elevated workstation which allows for comfortable pedal actuation while engaging the most prevalently used pedals, the forward speed controls 6. The operator's foot can maintain a flat position supporting his or her weight on the surface of the platform 11 as well as the pedal step surface 7 during the predominant pedal actuation position which is full speed forward sewing.

The platform 11 incorporates a non-slip padded work surface 12, a wooden structural base 13, and a non-slip floor contact 14 designed with recesses 18 for flush mounting of the pedal hinge bases 9. A beveled workstation edge molding 15 is provided as a safety feature and a structural support for the integrated platform. This edge molding 15 is painted with a highly visible color to avoid accidental tripping and clearly demarcate the workstation. The forward speed control pedals 6 have an attached forward speed lever arm actuator rod 4 which transmits engagement of the pedal 6 through a contact bracket 3 to the signal lever arm 2. A protective lever arm contact covering 17 is provided to allow adaptation of the integrated control system with preexisting machinery control devices likely to be found already in place as a part of the industrial sewing machine. The linkage between the pedals 6 through the actuator rod 4 may be provided with a position return biasing device, such as a spring. The sewing machine controlled with the instant invention incorporates a preexisting spring loaded signal lever arm prevalent in the prior art. The forward speed control pedal 6 includes a pedal step surface 7 usually made of non-slip surface. A pedal hinge 8 provides a rotatable connection with the pedal hinge base 9.

As an integrated structure, the base 13 includes a forward pedal actuation stop 20 that defines a channel and is integrated in height with the pedal 6 and the work surface 12 to provide an even surface between the top of the pedal step surface 7 and workstation surface 12 when the pedal 6 is fully engaged during the predominant period of operation. Adjustment of signal lever arm 2 actuation at the position where the step surface 7 and the workstation surface 12 are level is controllable through the shape of the link between the forward speed lever arm actuator rod 4 and the forward speed lever arm contact bracket 3. In this embodiment, the forward speed control pedal 6 is engagable to control through an infinite range of forward sewing from initial engagement to the desired, predetermined full-speed rate of sewing.

A second operation in the industrial sewing control system provided by the preferred embodiment includes the backtack and cut operation whereby the control reverses the sewing direction for a predetermined distance, lifts the fabric guide foot, and performs an automatic cut of the sewing thread. These operations of the sewing machine are not shown as they are prevalent in the prior art. However, what is depicted as part of this preferred embodiment is the provision of reciprocal backtack and cut control pedals 16. The backtack pedal structure 16 includes a pedal step surface 7 which engages a backtack and cut lever arm actuator rod 5 providing rotation along this rod which is transmitted as a distinct control of the signal lever arm 2 through a backtack and cut lever arm contact bracket 5*a*. The rotation of the backtack actuator rod 5 is aligned within actuator rod bearing brackets 10 holding the rod within the channel 19 formed between the front edge of the structural base 13 and the back edge of the forward speed pedal actuation stop 20.

The improved ergonomic symmetric pedal control system 30 of the present invention, shown in FIGS. 2-19, comprises, consists of, and consists essentially of reciprocally operating dual pedal sets 34 and 36, a control tower 32, and ergonomic anti-fatigue mat 50 having selected ergonomic characteristics known as 'compression set' and 'compression deflection'. The pedals 341, 342, 361 and 362 are oval shaped which are less likely to get caught on the edge of an operators shoes than the rectangular pedals 6 and 16 of the design in FIG. 1. A selected portion of each of the pedals include upwardly pointing rows and columns of pyramidal gripping members to provide a non-skid surface. Inner pedals 341 and 342, and outer pedals 361 and 362 constitute reciprocally matched pedal sets in that either pedal of the pedal set (341, 342) and (361, 362) can be used for the same purpose and that the pairs of pedals of each set are equidistant from the center of the symmetric pedal control system 30. Having these pedals disposed on either side of the control system gives the operator the option of using one or the other as desired.

Figure 1:
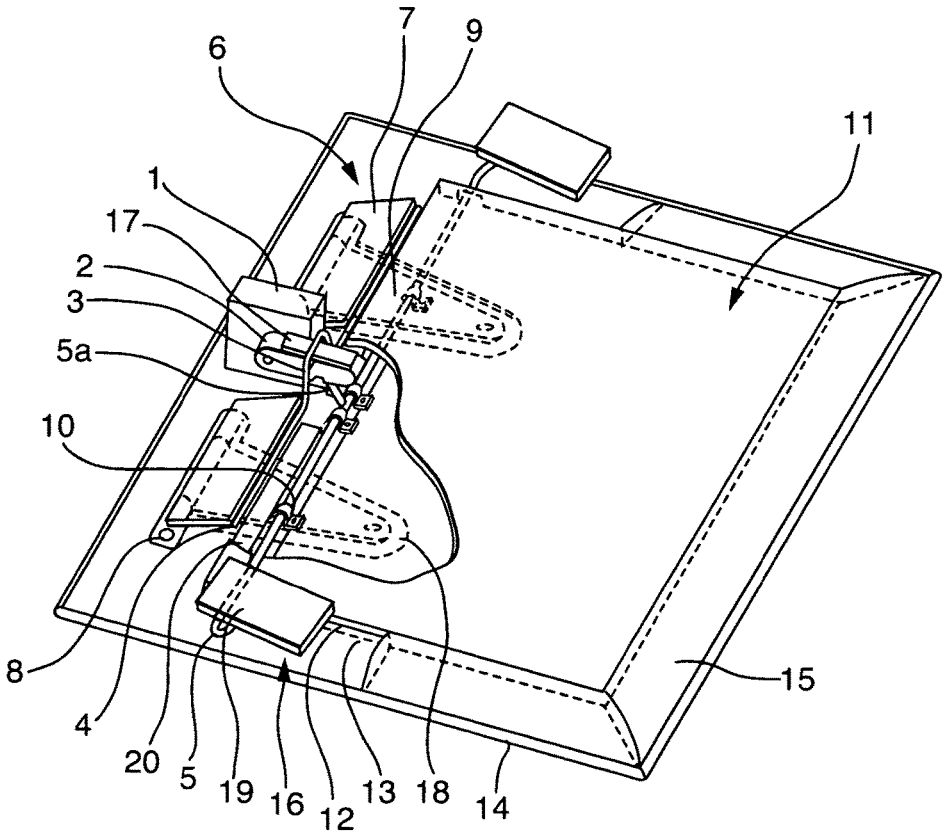
FIG. 1 PRIOR ART
FIG. 1 is a perspective view of a conventional embodiment of a pedal control system as shown in U.S. Pat. No. 5,351,571.
Figure 2:
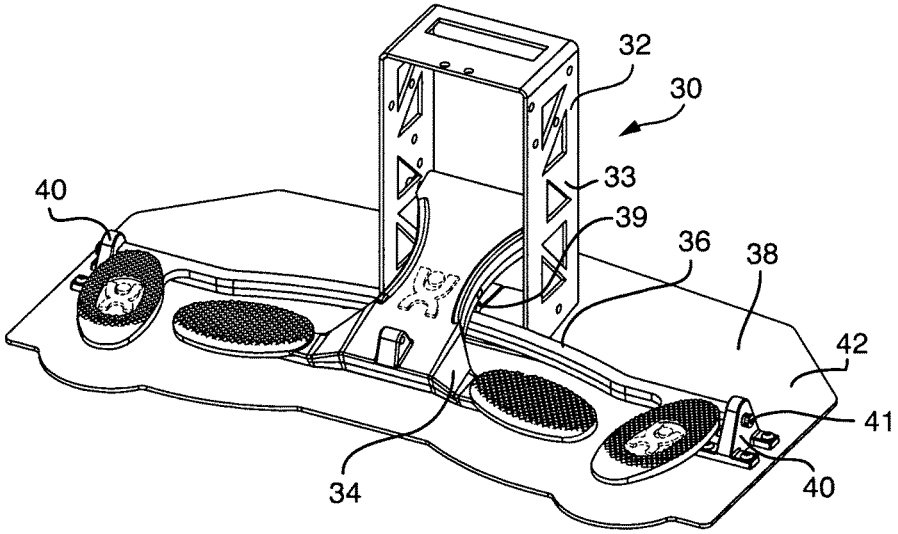
FIG. 2 is a perspective view of one embodiment of the symmetric pedal control system 30 including a control tower 32 and interlocking pedal members 34 and 36.
Figure 3:
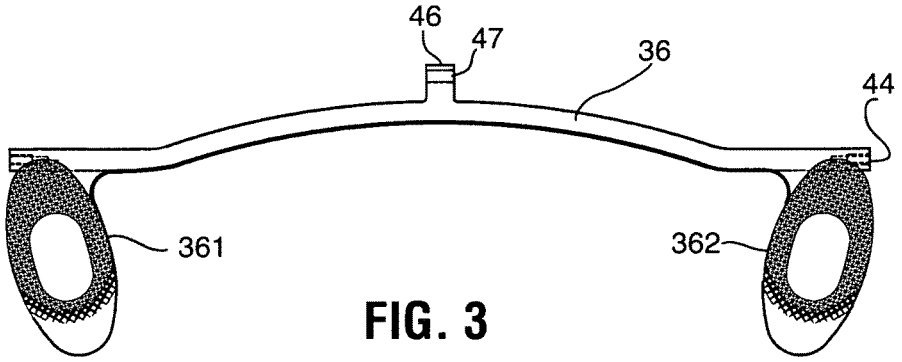
FIG. 3 is a top view of the 'cut control' pedal 36.
Figure 4:
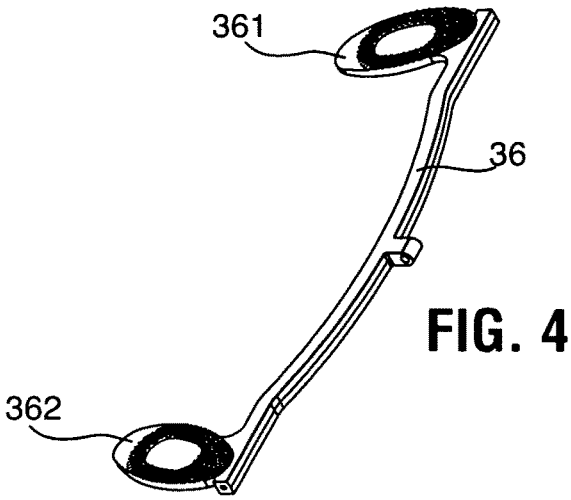
FIG. 4 is a perspective view of the 'cut control' pedal 36.
Figure 5:
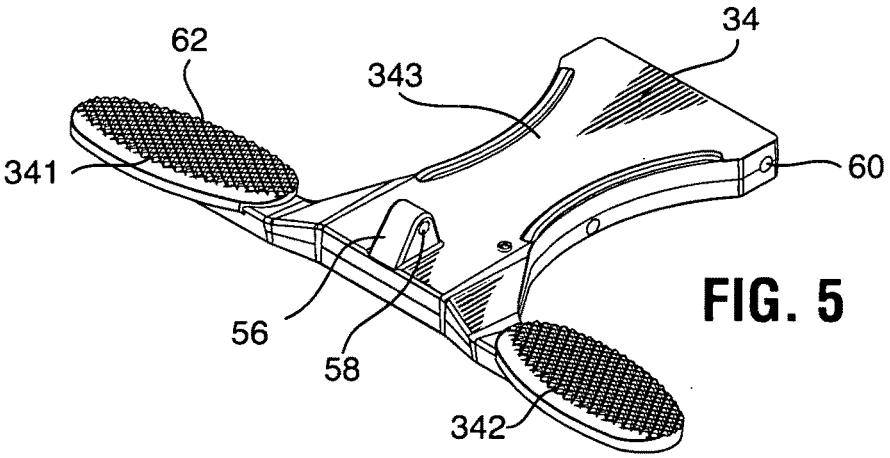
FIG. 5 is a top perspective view of the 'forward control' pedal 34.
Figure 6:
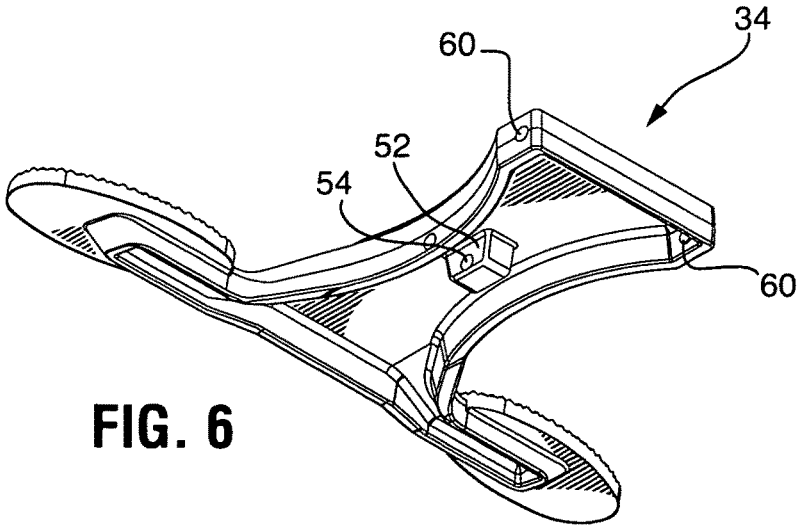
FIG. 6 is a bottom perspective view of the 'forward control' pedal 34.
Figure 7:
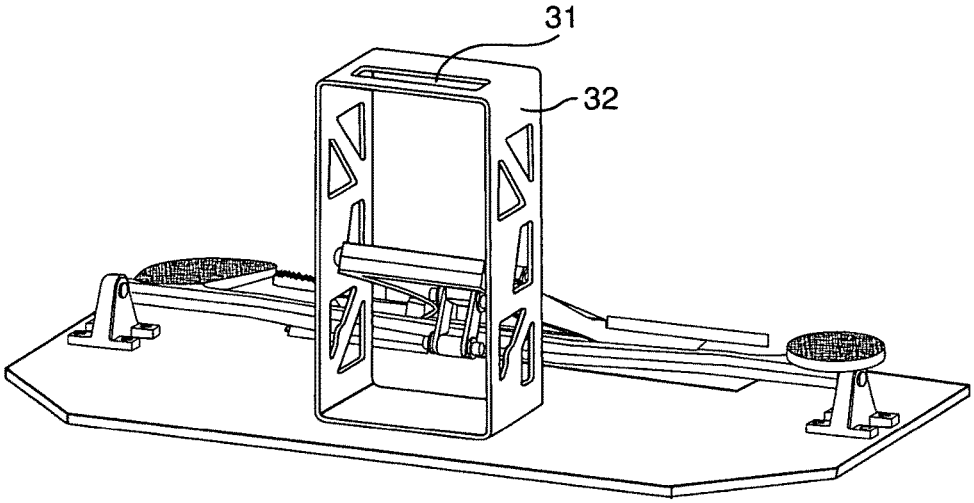
FIG. 7 is a rear perspective view of the symmetric pedal control system 30.

As shown in FIGS. 2 and 3, dual cut control pedal set 36 pivots with respect to pivot blocks 40 on pins 41 about axis 44 so that when either pedal 361 or pedal 362 is pushed downward, lug 46 is raised upward. Pivot blocks 40 are fixedly connected to the top surface 38 of base 42. Cut control pedal set 36 includes the left pedal 361 and the right pedal 362. The lug 46 on the central forward edge of pedal set 36 includes an aperture 47 whose axis is parallel to axis 44 in pedal set 36.

The control tower 32 is fixedly connected to the upper surface of base 42 and includes an aperture 31 in the top surface which provides a handle for carrying the symmetric pedal control system 30. The tower 32 contains at least two further apertures 33, one on each side of the control tower 32 for cooperative engagement with studs 60 on the forward control pedal set 34, best shown in FIGS. 5 and 6 include a body member 343 with a left inner pedal 341 attaching on the left lower edge of the body member 343 and a right inner pedal 342 attaching to the right lower edge of the rectangular body 343. The upper surfaces of the rectangular body 343 and the two pedals 341 and 342 are approximately coplanar. The two inner pedals 341 and 342 are oval shaped and their upper surfaces 62 are covered with upward pointing pyramidal shoe sole gripping members. A downward pointing lug 52 is attached to the bottom surface of the body member 343 roughly in the center and contains an aperture 54 whose axis is parallel to the axis 44 of the pedal set 36. An upward pointing lug 56 is located near the bottom edge of member body 343. Lug 56 also contains an aperture 58 whose axis is also parallel to axis 44 of pedal set 36.

Figure 11:
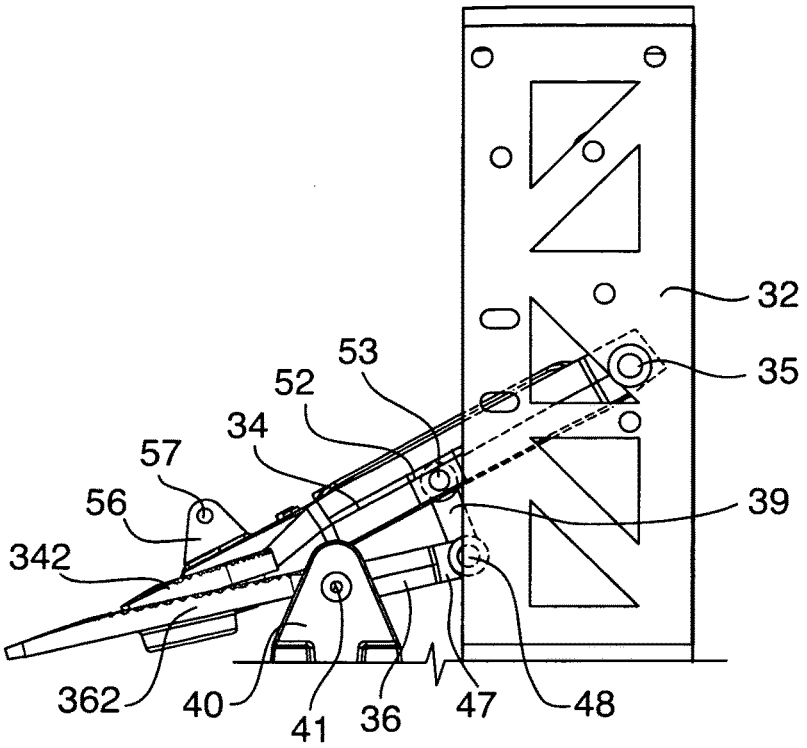
FIG. 11 is a side view of the control tower and inter locking pedals of the symmetric pedal control system 30.

As shown in FIG. 11, cut control pedal set 36 pivots with respect to pivot block 40 about pin 41. Lug 46 of cut control pedal 36 is pivotally connected to link arm 39 by pin 48. Link arm 39 also is pivotally connected to lug 52 of forward control pedal set 34 by pin 53. Forward control pedal set 34 pivots with respect to control tower 32 about pin 35. Thus, it can be seen that lug 56 at the lower edge of forward control pedal set 34 moves downward when either inner pedal 341 or 342 is pushed downward. Conversely, when either outer pedal 361 or 362 of the cut control pedal set 36 is pushed downward, lug 46 of cut control pedal set 36 pushes link arm 39 upward, thus pushing lug 52 of forward control pedal set 34 upward, and therefore causing lug 56 to move back to the initial position.

As illustrated in FIG. 8, the top surface 88 of mat 50 extends above the top surface of base 42. This feature provides that when pedal set 34 is pressed completely downward, the top surfaces 363 of inner pedal 341 and 342 are nearly even with the top surface of mat 50. Further, recesses 86 and 84 are located under outer pedals 361 and 362, respectively. When pushing outer pedal 361 or 362 downward, these pedals bottom out with their top surfaces near the top surface of mat 50, as well. These features allow for more comfortable and un-impeded operation of pedals 341, 342, 361 and 362.

One method of using the symmetric pedal control system 30 as shown in FIG. 8, includes the use of a link arm 80 which pivotally connects lug 56 to the control arm 72 of speed controller 70. Pushing downward on either of forward control inner pedals 341 or 342 causes control arm 72 to be pushed downward. Pushing the control arm 72 downward starts and speeds up the machine. Moving the control arm upward slows down the machine. When the control arm 72 is pushed fully upward, the machine stops. If the machine in question is a sewing machine, the sewing machine may be configured so that a 'back tack' step is performed before coming to a complete stop. It can be seen that pushing down on either of the 'forward control' inner pedals 341 or 342 will cause the machine to start or go 'forward'. Further, pushing down on either of the 'cut control' outer pedals 361 or 362 will cause the machine to stop or in other words for the control to be 'cut' off. Speed controller 70 includes a wiring harness (not shown) with a quick connect coupling (not shown) which may be quickly connected to any machine to be controlled by the control system 30.

The cut control pedal set 36 is positively linked to the forward control pedal set 34 through pivot pins 41, 48, 53, and 35. Thus it can be stated that applicant's quadruple pivot pin system provides a positive machine cut off feature because pushing down on either of the cut control pedals 361 or 362 will positively push the forward control pedal set 34 back to a stop position.

Figure 12:
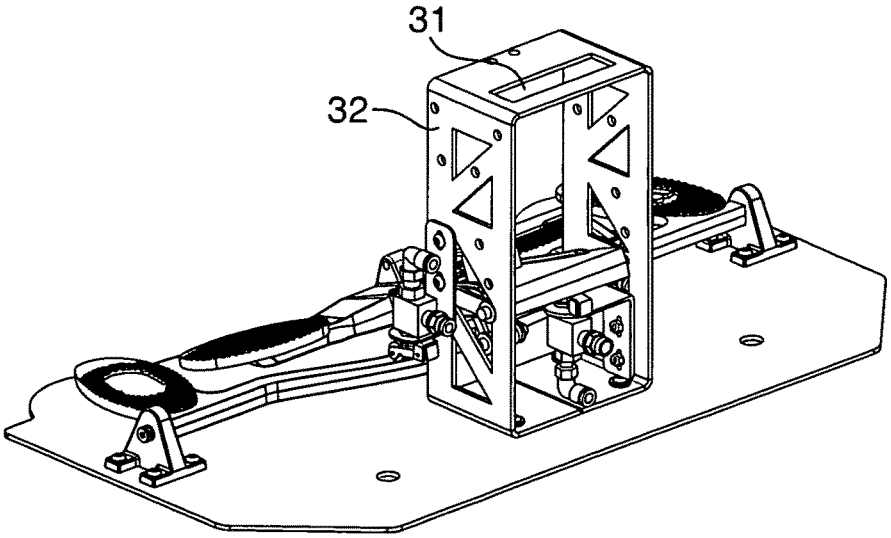
FIG. 12 is a rear perspective view of the symmetric pedal control system 30 including pivot arm controlled air valves.
Figure 13:
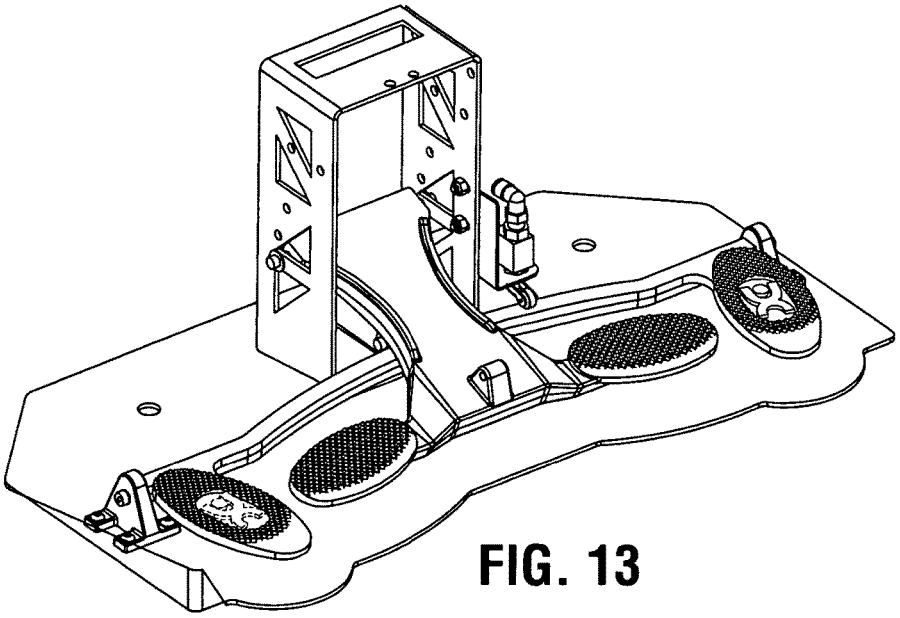
FIG. 13 is a front perspective view of the symmetric pedal control system 30 of FIG. 12.
Figure 14:
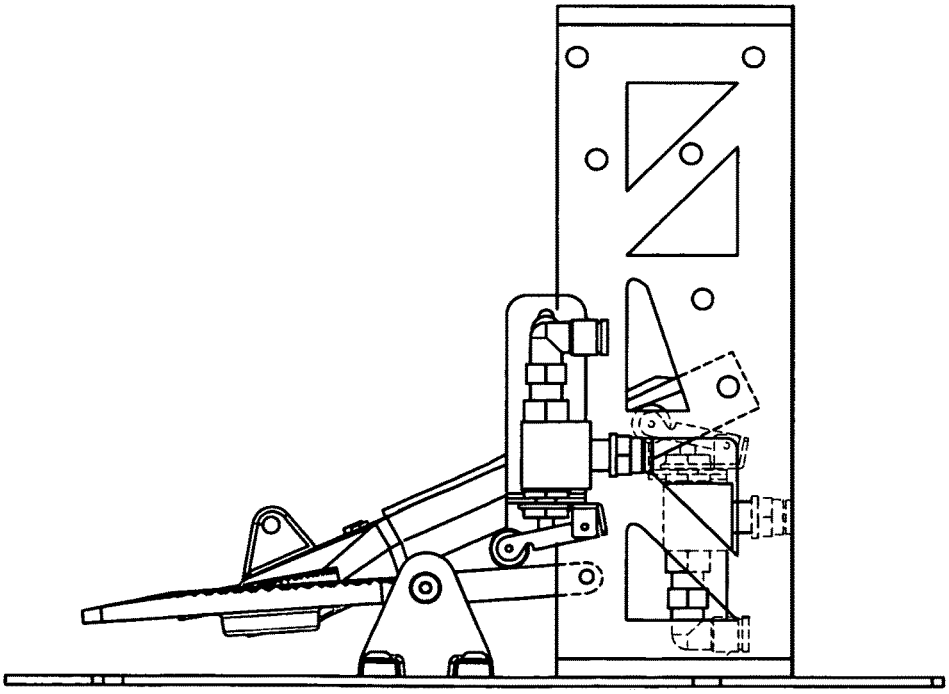
FIG. 14 is a side view of the symmetric pedal control system 30 of FIG. 12.

Alternatively, as shown in FIGS. 12-14, the pedal sets can be fitted with air valves 90 and 91 for pneumatic control of the machine rather than using an electrical speed controller 70 as shown in FIG. 8. The control link 92 is moved to open or close valve 90 by moving pedal 361 or 362. The control link 93 is moved to open or close valve 91 by moving pedal set 34 up or down. Control valves 90 and 91 include pneumatic hoses with quick disconnects for easy connection to any machine to be controlled by this system.

Figure 9:
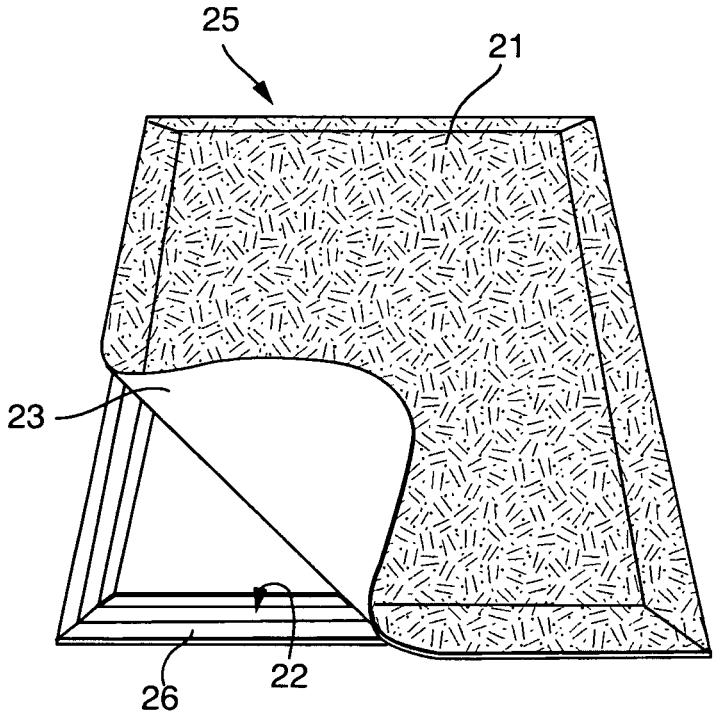
FIG. 9 is a top perspective view of an anti-fatigue mat 25 which is optionally utilized together with the pedal control system.
Figure 10:
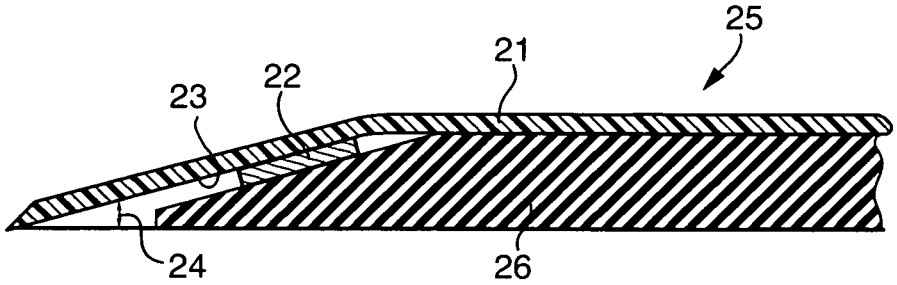
FIG. 10 is a cross-sectional view of the outer marginal portion of an anti-fatigue mat 25.

With reference to FIGS. 9 and 10, a mat 25 includes a multilayer thickness for supporting at least a human body thereon, the multilayer mat has a non-slip outer layer 21, a compressible layer 26, and a peripheral frame member (spine) 22 disposed between the outer layer 21 and the compressible layer 26. The non-slip outer layer 21 may includes protrusions, abrasive surfaces, such as silica coating, or patterns, such as diamond tread. This non-slip outer layer 21 serves as the contact point of the user standing or moving on the matting 25. Nonetheless, a user may ambulate on the outer layer 21 without slipping under normal use. Compressible layer 26 can absorb a portion of the weight of a user on the matting 25 to help reduce standing fatigue.

In a preferred construction, the peripheral spine 22 defines a flexible performance framework 22 of the matting 25. In one aspect, the performance framework 22 advantageously enables long runs of the matting 25 to be stationary thereby preventing "snaking" or "shifting" of the matting when deployed on a floor surface. This innovative performance framework 22 also prevents the edges of the matting 25 from warping or coming up off the floor surface. The construction of the matting 25 prevents bunching up, or rolling up thereby significantly reducing safety hazards in the workplace. This construction solves the warping and hazard problems which are a significant source of complaints and recordable safety hazards of conventional anti-fatigue matting.

Referring to FIGS. 9 and 10, a preferred construction of mat 25 comprises a semi-rigid strip of plastic material 22 such as vinyl or other appropriate material bonded inside the perimeter and to the underside 23 of the outer/top layer 21 of vinyl material and to the top side of the tapered edge 32 of the next sponge layer 26. The top vinyl material 21 is more flexible or able to bend more than the strip 22 of material. Advantageously, the strip 22 provides rigidity to the top layer 21 of material. In one construction, the strip 22 can be approximately ⅛ inch thick and have a width of about ½-¾ inch. However, other dimensions are possible. In the most preferred construction, the sponge layer 26 is tapered to direct the edge of the top vinyl surface 21 to the floor. The rigid vinyl strip 22 is not parallel to the floor 50, but projects downwardly at a selected angle "theta" generally equal to the angle of the tapered sponge inner layer edge. The angle 24 may range from 2 degrees to 45 degrees from the horizontal. Alternatively, the angle 24 may be in the range from 25 degrees to 26 degrees from the horizontal. Nevertheless, other values are possible, such as 31 degrees to 42 degrees. Thus, this angle of construction of matting 25 together with the flexible top material which bends more than the rigid strip around the periphery creates a suction-like pressure which enables the edge of the matting 25 to adhere to a floor surface, such as a concrete floor, thereby providing consistent sure footed traction of a human body walking or otherwise moving on the matting 10. In this manner, a matting construction includes an air bonding function to maintain a stationary position during use on a floor surface.

One preferred embodiment of the symmetrical pedal control system, as shown in FIG. 8, includes an anti-fatigue mat 50 as configured in FIGS. 9 and 10 and described above, wherein the mat comprises material with a combined compression set in the range of 3 to 40% and a compression deflection in the range of 3 to 70 psi. Because selected anti-fatigue mats 50 have various compression set and compression deflection values chosen for particular operators, the ergonomic pedal control system 30 of FIG. 8 is easily separable and portable from one machine to another, so that when an operator is moved from one machine to another, he may disconnect his pedal control system for quick connection to the machine to which he is moving. Quick disconnect wiring or pneumatic lines allow the system to be moved from one machine to another so that an operator can carry his ergonomic pedal control system 30 along with him. The handle 31 provides a convenient means for carrying the system.

Figure 15:
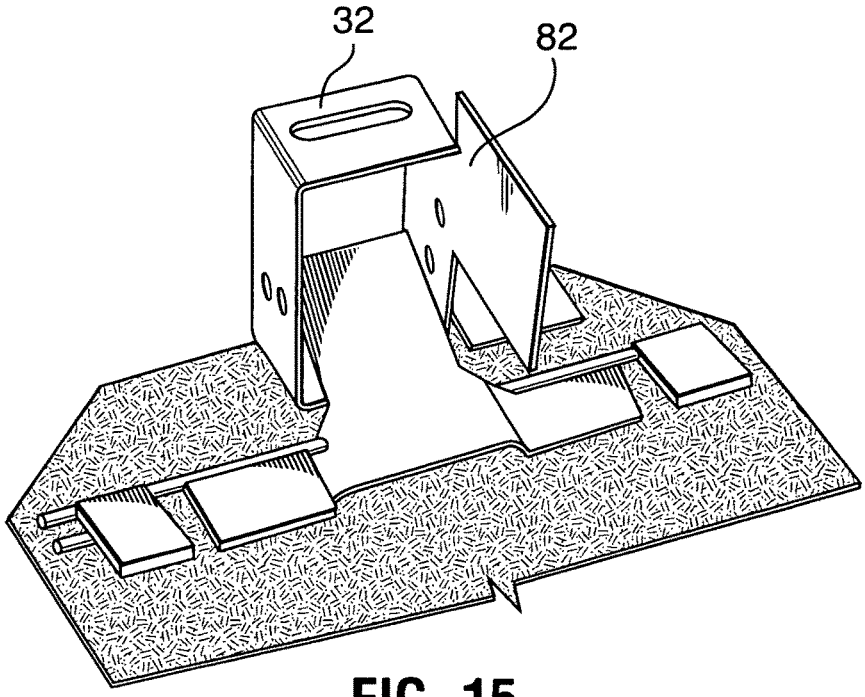
FIG. 15 is a perspective view of the symmetric pedal control system 30 including pivot arm controlled air valves.
Figure 16:
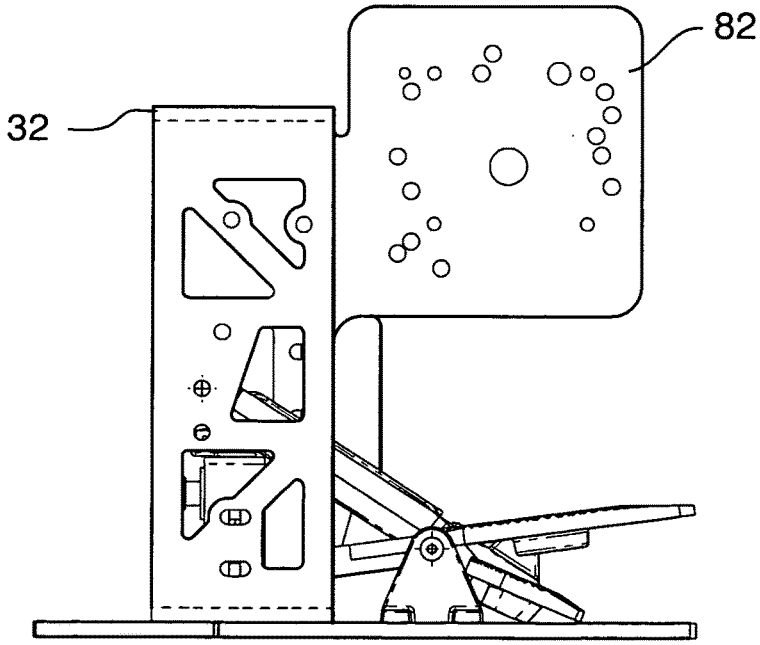
FIG. 16 is a side view showing of the symmetric pedal control system 30 wherein the tower includes a bracket for mounting and electronic speed control device and the inner pedal is in the maximum depressed down position.
Figure 17:
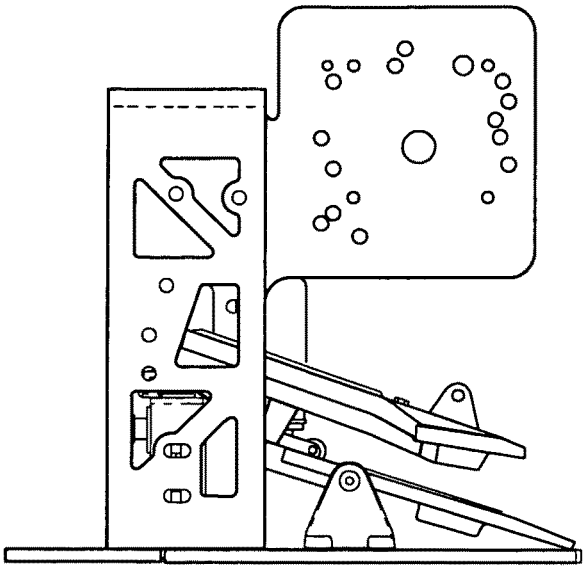
FIG. 17 is a side view showing the outer pedal in the maximum down position.
Figure 18:
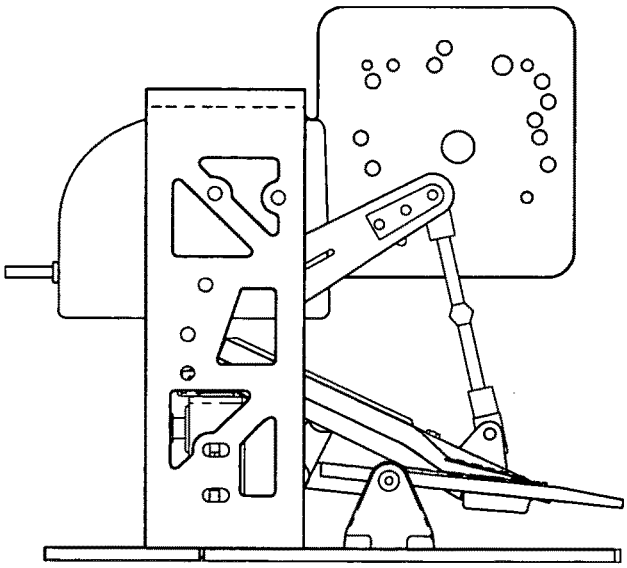
FIG. 18 is a side view showing the pedals adjusted to minimal level with EFKA speed control.
Figure 19:
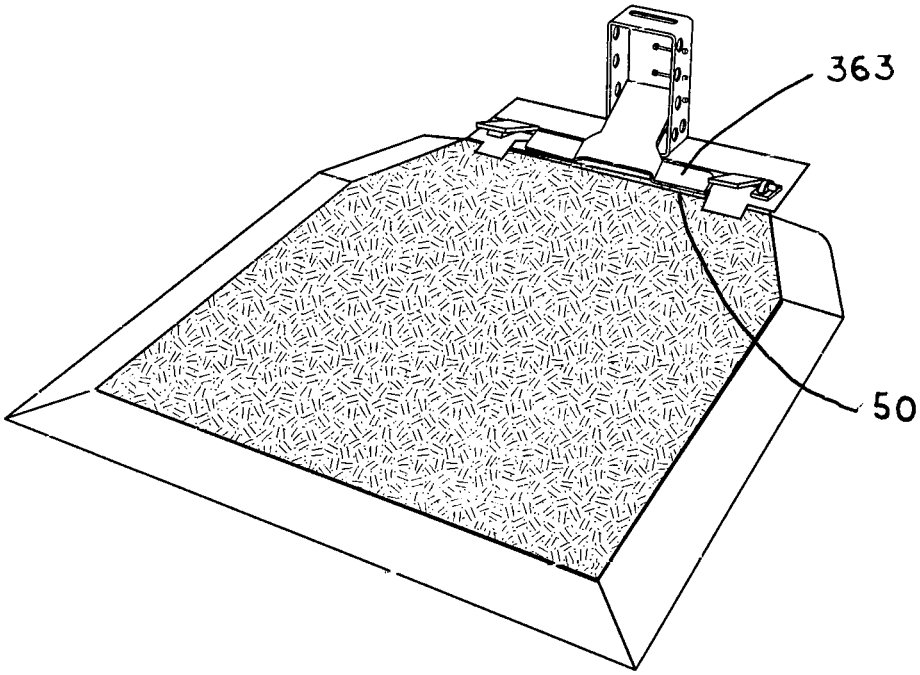
FIG. 19 is a perspective view showing the platform with mat.
Figure 20:
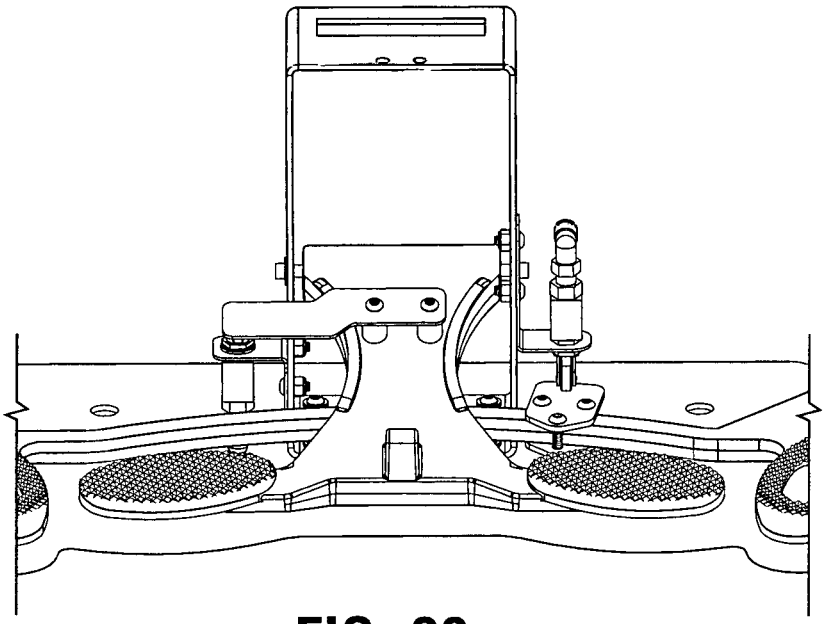
FIG. 20 is a front perspective view of the symmetric pedal control system including pivot arm controlled air valves.
Figure 21:
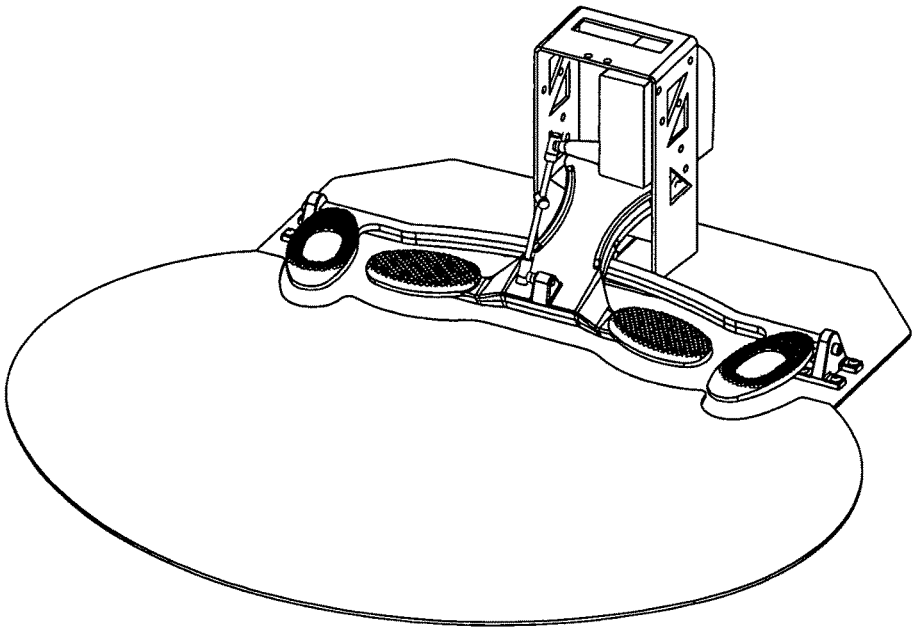
FIG. 21 is a front perspective view of the symmetric pedal control system showing the use of a link arm which pivotally connects lug to the control arm of the speed controller.
Figure 22:
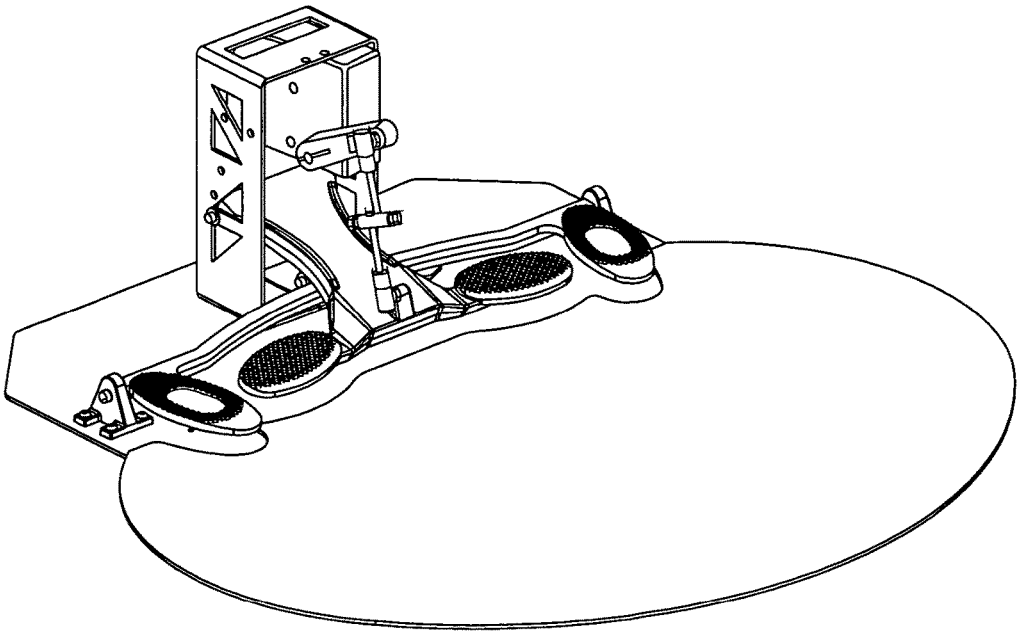
FIG. 22 is a perspective side view of the symmetric pedal control system showing the use of a link arm which pivotally connects lug to the control arm of the speed controller.
Figure 23:
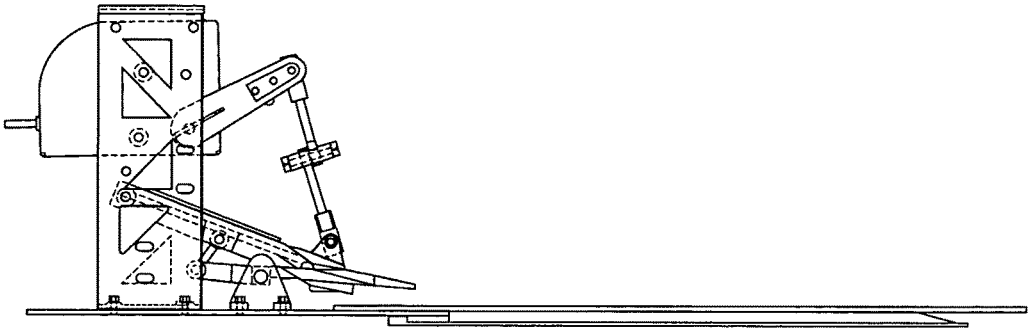
FIG. 23 is a side view of the symmetric pedal control system showing the use of a link arm which pivotally connects lug to the control arm of the speed controller.

Another embodiment, shown in FIG. 15 includes control tower 32 with an extended lateral panel 82 specifically configured for mounting typical electronic controls.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

The invention claimed is:

1. An ergonomic sewing machine pedal control system, comprising:

a) a base including a control tower;

b) a control pedal assembly connected to said base including:

a first pair of reciprocally matched pedals comprising a first pedal and a second pedal pivotally connected and mechanically linked to a second pair of reciprocally matched pedals comprising a third pedal and a fourth pedal, said first pair of reciprocally matched pedals are connected to said second pair of reciprocally matched pedals, whereby said first pair of reciprocally matched pedals is returned to a selected position when said second pair of reciprocally matched pedals is depressed;

said control tower including a symmetric pedal control system for generating a control signal to and receiving a signal from said first pair of reciprocally matched pedals comprising said first pedal and said second pedal, and said second pair of reciprocally matched pedals comprising said third pedal and said fourth pedal, such that said control signal from said first pair of reciprocally matched said first pedal and said second pedal sends a corresponding control signal to a selected one of said third pedal or said fourth pedal of said second pair of reciprocally matched pedals;

means for communicating said control signal to a sewing machine, said first pedal, said second pedal, said third pedal, and said fourth pedal each have having a selected position with respect to said control tower;

c) a platform contiguous to and cooperatively engaging said base for supporting an operator, wherein said first pair of reciprocally matched pedals and said second pair of reciprocally matched pedals are disposed adjacent to and about said platform in a mirrored image fashion;

d) said first pedal, said second pedal, said third pedal, and said fourth pedal of said first pair of reciprocally matched pedals and said second pair of reciprocally matched pedals, respectively, are arranged so that when operated a top surface of said first pedal, said second pedal, said third pedal, and said fourth pedal of said first pair of reciprocally matched pedals and said second pair of reciprocally matched pedals is aligned approximately even with a support surface of said platform allowing for pedal actuation with an operator's foot in a flat position supporting his or her weight on said support surface of said platform and a pedal step surface during a predominant pedal actuation position which is full speed forward sewing.

2. The ergonomic sewing machine pedal control system described in claim 1, wherein said first pedal, said second pedal, said third pedal, and said fourth pedal are arranged so that when operated, said top surface of said first pedal, said second pedal, said third pedal, and said fourth pedal is aligned approximately even with a top surface of said platform.

3. The ergonomic sewing machine pedal control system described in claim 1, wherein said platform is sized to allow engagement of said first pair of reciprocally matched pairs of pedals by a first foot of said operator and engagement of said second pair of reciprocally matched pairs of pedals by a second foot of said operator.

4. The ergonomic sewing machine pedal control system described in claim 1, wherein said top surface of said first pedal and said second pedal of said first pair of reciprocally matched pedals and said third pedal and said fourth pedal of said second pair of reciprocally matched pedals include a place of engagement by a foot of said operator which is slanted toward said base and located adjacent to an edge of said platform.

5. The ergonomic sewing machine pedal control system described in claim 1 wherein said first pedal and said second pedal each have a forward operative pedal selection operable by a left foot within a 5"-10" range of engagement from an operative center point of said control tower and said third pedal and said fourth pedal each have a forward operative pedal selection operable by a right foot within a 5"-10" range of engagement from an operative center point of said control tower to control the same function.

6. The ergonomic sewing machine pedal control system described in claim 1 wherein a pedal control assembly includes said first pair of reciprocally matched pedals and said second pair of reciprocally matched pedals operable by a right foot or left foot with a pivotal range from a heel of up to 10" from an operative center point of said control tower.

7. The ergonomic sewing machine pedal control system described in claim 1 wherein said first pair of reciprocally matched pedals and said second pair of reciprocally matched pedals operates one to four sewing machine functions.

8. The ergonomic sewing machine pedal control system described in claim 1 wherein an outer pedal selected from said first pair of reciprocally matched pedals and an outer pedal selected from said second pair of reciprocally matched pedals have the same function, and an inner pedal selected from said first pair of reciprocally matched pedals and inner pedal selected from said second pair of reciprocally matched pedals have the same function.

9. The ergonomic sewing machine pedal control system described in claim 1, wherein an outer pedal selected from said first pair of reciprocally matched pedals and an outer pedal selected from said second pair of reciprocally matched pedals are positioned within 14 to 19 inches from an operative center point of said control tower.

10. The ergonomic sewing machine pedal control system described in claim 1, wherein an axis of rotation from a horizontal center mid plane parallel to said base of said first pedal, said second pedal, said third pedal, and said fourth pedal have a minimum to a maximum angle of rotation plus or minus fifty degrees upward or downward motion.

11. The ergonomic sewing machine pedal control system described in claim 1, wherein said first pedal, said second pedal, said third pedal, and said fourth pedal have a shape selected from the group consisting of an angular surface, a curved surface, a curved flat surface and a curved raised surface.

12. The ergonomic sewing machine pedal control system described in claim 1, wherein said first pair of reciprocally matched pedals includes a left outer pedal and said second pair of reciprocally matched pedals includes a right outer pedal mechanically linked to one another for controlling the same backtack and cut function reversing a sewing direction for a predetermined distance and performing an automatic cut of a sewing thread and said first pair of reciprocally matched pedals includes a left inner pedal and said second pair of reciprocally matched pedals includes a right inner pedal mechanically linked to one another for controlling a variable forward speed.

13. A symmetric pedal control system for a sewing machine, comprising:

a base having a support structure that supports a standing operator and a pedal control system mounting on said base;

said pedal control system having an inner pedal set of reciprocally matched pedals and an outer pedal set of reciprocally matched pedals mounted to said base in a mirrored image fashion;

a said inner pedal set of said reciprocally matched pedals pivotally connecting to said outer pedal set of reciprocally matched pedals so that said inner pedal set is returned to a selected position when said outer pedal set is depressed and vice versa;

a control tower mounted to said base;

said pedal control system mounting to said control tower for generating a control signal to and receiving a signal from depression of each pedal of said inner pedal set and said outer pedal set whereby said inner pedal set and said outer pedal set send and received said control signal to said sewing machine;

said inner pedal set and said outer pedal set are disposed equi-distant from the center of said control tower, said inner pedal set including a left inner pedal and a right inner pedal, and said outer pedal set including a left outer pedal and a right outer pedal;

said control signal sent or receive from depression of said left outer pedal and said left inner pedal are operable with either an operator's left foot or right foot standing on a left side of said control tower, and said control signal sent or received from depression of said right outer pedal and said right inner pedal are operable with either an operator's left foot or right foot standing on a right side of said control tower providing said operator an option of operating said sewing machine while standing on either the left or right side of said control tower;

said left outer pedal and said right outer pedal of said outer pedal set are mechanically linked to one another each one controlling back tack reversing a sewing direction, and a cut of a sewing thread;

said left inner pedal and said right inner pedal of said inner pedal set are mechanically linked to one another for controlling a variable forward speed;

said inner pedal set remaining in a flat position supporting the weight of an operator's foot on a pedal step during a pedal actuation position;

said inner pedal set controlling said variable forward speed control providing a range of forward sewing speeds from an initial engagement to a predetermined full-speed rate of sewing;

a platform contiguous to and cooperatively engaging said base for supporting an operator, wherein said first pair of reciprocally matched pedals and said second pair of reciprocally matched pedals are disposed adjacent to and about said platform in a mirrored image fashion;

said platform having a surface generally even with a fully engaged inner pedal set step surface or a fully engaged outer pedal set step surface during operation providing a generally coplanar surface between said top surface of said platform and said inner pedal set step surface and said outer pedal set step surface.

14. The symmetric pedal control system for a sewing machine of claim 13, wherein a selected portion of said top surface of said outer pedal set and said inner pedal set is texturized with an anti-skid treatment selected from the group consisting of upwardly facing pyramids, bumps, pebbles, protrusions, silica coating, diamond tread pattern, and combinations thereof providing traction and/or cushioning.

15. The symmetric pedal control system for a sewing machine of claim 13, said platform including a recess under said outer pedal set of reciprocally matched pedals for receiving a portion thereof providing a generally coplanar surface therebetween.

16. A symmetric pedal control system for a sewing machine, comprising:

a base having a support structure that supports a standing operator and a pedal control system mounting on said base, said pedal control system having an inner pedal set of reciprocally matched pedals and an outer pedal set of reciprocally matched pedals mounted to said base in a mirrored image fashion;

a reciprocal pedal control for operation of the sewing machine;

said inner pedal set of reciprocally matched pedals pivotally connecting to said outer pedal set of reciprocally matched pedals so that said inner pedal set of reciprocally matched pedals is returned to a selected position when said outer pedal set of reciprocally matched pedals are is depressed and vice versa;

a control tower mounted to said base;

said control tower including a symmetric pedal control system for generating a control signal to and receiving a signal from each pedal of said inner pedal set and said outer pedal set such that a corresponding pedal in the reciprocally matched pairs of said inner pedal set and said outer pedal set send and received said same control signal to a means for communicating said control signal to said sewing machine;

said inner pedal set and said outer pedal set are disposed equi-distant from the center of said control tower, said inner pedal set comprising a left inner pedal and a right inner pedal and said outer pedal set comprising a right outer pedal and a left outer pedal;

said control signal sent or received from said left outer pedal and said left inner pedal are operable with either an operator's left foot or right foot standing on a left side of said control tower, and said control signal sent or received from said right outer pedal and said right inner pedal are operable with either an operator's left foot or right foot standing on a right side of said control tower providing said operator an option of operating said sewing machine while standing on either the left or right side of said control tower;

said left outer pedal and said right outer pedal of said outer pedal set are mechanically linked to one another each one controlling back tack reversing a sewing direction for a predetermined direction, and a cut of a sewing thread by engaging either said left outer pedal or said right outer pedal;

said left inner pedal and said right inner pedal of said inner pedal set are mechanically linked to one another, each one controlling a variable forward speed control;

said inner pair of pedals remaining in a flat position supporting the weight of an operator's foot on a pedal step surface during a pedal actuation position, said inner pair of pedals controlling said variable forward speed control providing a range of forward sewing speeds from an initial engagement to a full-speed rate of sewing;

said base having a platform surface providing a generally even top surface between a left inner pedal step surface and a right inner pedal step surface when said left inner pedal or said right inner pedal is fully engaged during operation.

17. The symmetric pedal control system for a sewing machine of claim 16, wherein said multilayer mat further comprises an open cell polyurethane or a closed cell polyvinyl chloride.

18. The symmetric pedal control system for a sewing machine of claim 16, wherein a selected portion of said top surface of said outer pedal set and said inner pedal set is texturized with an anti-skid treatment selected from the group consisting of upwardly facing pyramids, bumps, pebbles, protrusions, silica coating, diamond tread pattern, and combinations thereof providing traction and/or cushioning.

19. The symmetric pedal control system for a sewing machine of claim 16, wherein said pedal control system includes four forward operative pedal selections that can be operated by either the right foot or the left foot with a range of five to nineteen inches from said control tower.

20. The symmetric pedal control system for a sewing machine of claim 16, wherein said multilayer mat comprises a non-slip outer layer, a compressible layer, a peripheral frame member disposed between an outer layer and said compressible layer.

21. The symmetric pedal control system for a sewing machine of claim 16, wherein a distance between said inner pedal step surface and said platform surface is in a range of five sixteenth to three sixteenths inches.

22. The symmetric pedal control system for a sewing machine of claim 16, said platform including a recess under said left outer pedal and said right outer pedal for receiving a portion of said left outer pedal and said right outer pedal providing a generally coplanar surface between said left inner pedal step surface and said right inner pedal step surface when said left inner pedal or said right inner pedal is fully engaged during operation.

23. The symmetric pedal control system for a sewing machine of claim 16, said platform comprising a multilayer mat having a compression set ranging from 3 to 40% and a compression deflection ranging from 3 to 30 pound per square inch.

* * * * *